US007497071B2

(12) United States Patent
Tillberg

(10) Patent No.: US 7,497,071 B2
(45) Date of Patent: Mar. 3, 2009

(54) CHAIN PULLER

(76) Inventor: Richard Tillberg, Box 134, Widewater, AB (CA) T0G 2M0

( * ) Notice: Subject to any disclaimer, the term of this patent is extended or adjusted under 35 U.S.C. 154(b) by 0 days.

(21) Appl. No.: 11/843,865

(22) Filed: Aug. 23, 2007

(65) Prior Publication Data

US 2008/0047251 A1 Feb. 28, 2008

Related U.S. Application Data

(60) Provisional application No. 60/840,362, filed on Aug. 25, 2006.

(51) Int. Cl.
*B66F 3/10* (2006.01)
*B21L 21/00* (2006.01)

(52) U.S. Cl. ..... 59/7; 254/231; 254/234; 59/11; 29/256; 24/68 CT

(58) Field of Classification Search ..... 59/7, 59/11, 8; 254/67, 100, 228, 231, 234; 29/256, 29/257; 24/68 CT
See application file for complete search history.

(56) References Cited

U.S. PATENT DOCUMENTS

| | | | | | |
|---|---|---|---|---|---|
| 762,060 | A | | 6/1904 | Huhn | |
| 775,355 | A | | 11/1904 | Smith | |
| 1,373,230 | A | | 3/1921 | Gainor | |
| 1,412,165 | A | * | 4/1922 | Cary | 254/234 |
| 1,505,549 | A | * | 8/1924 | Ferch | 254/234 |
| 1,710,092 | A | | 4/1929 | Hitchcock | |
| 1,817,628 | A | | 8/1931 | Kessler et al. | |
| 1,994,270 | A | | 3/1935 | Paterson | |
| 2,361,971 | A | | 11/1944 | Shipman | |
| 2,382,447 | A | | 8/1945 | Schauefele | |
| 2,387,551 | A | | 10/1945 | Abramson et al. | |
| 2,440,512 | A | * | 4/1948 | Jakoubek et al. | 59/7 |
| 2,826,893 | A | | 3/1958 | Leominster | |
| 2,950,899 | A | | 8/1960 | Wilson | |
| 2,990,738 | A | * | 7/1961 | Zysset | 269/97 |
| 3,002,726 | A | * | 10/1961 | Ford | 269/256 |
| 3,016,603 | A | | 1/1962 | Rutland | |
| 3,028,723 | A | | 4/1962 | Kaplan et al. | |
| 3,108,783 | A | * | 10/1963 | Foust et al. | 81/9.3 |
| 3,150,859 | A | | 9/1964 | Payne | |
| 3,172,250 | A | | 3/1965 | Eastep | |
| 3,379,005 | A | | 4/1968 | Jones | |
| 3,648,973 | A | | 3/1972 | Farrell | |
| 3,901,476 | A | | 8/1975 | Giampaglia | |

(Continued)

*Primary Examiner*—David B Jones
(74) *Attorney, Agent, or Firm*—Davis & Bujold, P.L.L.C.

(57) ABSTRACT

A chain puller includes an elongate housing having a C-shaped channel extending between the first end and the second end of the housing. First and second chain engaging members are provided. Each has a lower portion and an upper portion. The upper portion has a chain engaging face to be inserted between links of a chain. The lower portion of the first chain engaging member is fixedly attached toward the first end of the housing, and the lower portion of the second chain engaging member is slideably engaged within the C-shaped channel toward the second end of the housing. A screw actuator has a nut fixedly attached toward the second end of the housing relative to the second chain engaging member and a screw member engaged within the nut. The first end of the screw member has an engagement face that engages the second chain engaging member. The second end has means for rotating the screw member to cause the engagement face to advance or retract.

1 Claim, 2 Drawing Sheets

U.S. PATENT DOCUMENTS

| | | | | |
|---|---|---|---|---|
| 3,999,738 | A | | 12/1976 | Small |
| 4,030,286 | A | | 6/1977 | Gibilaro |
| 4,131,264 | A | * | 12/1978 | Patterson et al. ..... 24/68 CT |
| 4,157,171 | A | | 6/1979 | Hasselas |
| 4,201,367 | A | | 5/1980 | Konen, Sr. |
| 4,367,862 | A | | 1/1983 | McGregor |
| 4,394,810 | A | | 7/1983 | Womble |
| 4,429,525 | A | | 2/1984 | Doak |
| 4,476,615 | A | | 10/1984 | Cook |
| 4,602,414 | A | | 7/1986 | Bartholomew et al. |
| 4,718,228 | A | | 1/1988 | Moriki et al. |
| 4,768,753 | A | | 9/1988 | Gates |
| 4,833,875 | A | | 5/1989 | Buermann, Jr. et al. |
| 5,056,305 | A | | 10/1991 | Cole |
| 5,148,590 | A | | 9/1992 | Wu |
| 5,203,158 | A | | 4/1993 | Bowers |
| 5,205,543 | A | | 4/1993 | Thiede |
| 5,222,354 | A | | 6/1993 | Rothstein |
| 5,257,445 | A | | 11/1993 | Mayberry |
| D373,942 | S | | 9/1996 | Sears |
| 5,713,117 | A | | 2/1998 | Bliss |
| 5,787,701 | A | | 8/1998 | Small |
| 5,971,178 | A | | 10/1999 | Ratcliff et al. |
| 6,032,455 | A | | 3/2000 | Reimann |
| 6,170,142 | B1 | | 1/2001 | Paterson |
| 6,748,637 | B2 | | 6/2004 | Meggiolan |
| 6,880,323 | B2 | | 4/2005 | Coleman |

* cited by examiner

CHAIN PULLER

FIELD

The present application relates to a chain puller for pulling links of a chain together.

BACKGROUND

U.S. Pat. No. 5,056,305 (Cole) and U.S. Design Pat. No. D373,942 (Sears) each describe tools for pulling links of chain together.

SUMMARY

There is provided a chain puller including an elongate housing having a first end, a second end, and a C-shaped channel extending between the first end and the second end. A first chain engaging member has a lower portion and an upper portion. The upper portion has a chain engaging face to be inserted between links of a chain, and the lower portion is fixedly attached toward the first end of the housing. A second chain engaging member has a lower portion and an upper portion. The upper portion has a chain engaging face to be inserted between links of a chain, where the chain engaging face of the second chain engaging member faces the chain engaging face of the first chain engaging member. The lower portion is slideably engaged within the C-shaped channel toward the second end of the housing relative to the first chain engaging member such that the second chain engaging member slides along within the C-shaped channel between the first end and the second end. A screw actuator has a nut fixedly attached toward the second end of the housing relative to the second chain engaging member and a screw member engaged within the nut. The screw member has a first end and a second end. The first end has an engagement face extending into the C-shaped channel for engaging the lower portion of the second chain engaging member. The second end has means for rotating the screw member, such that rotation in a first direction causes the engagement face to advance toward the first end of the housing, and rotation in a second direction causes the engagement face to retract toward the second end of the housing.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
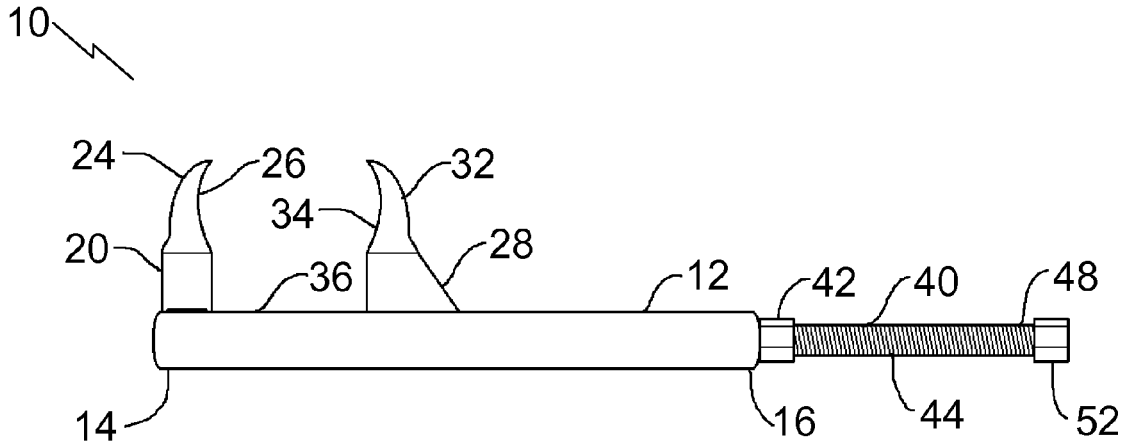
FIG. 1 is a side elevation view of a chain puller.

A chain puller generally identified by reference numeral 10, will now be described with reference to FIG. 1 through 5.

Figure 2:
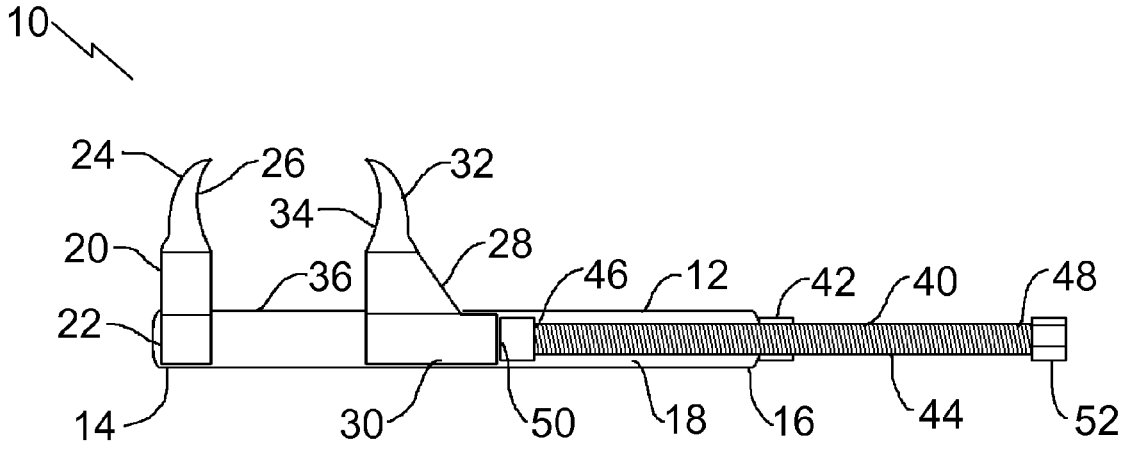
FIG. 2 is a side elevation view in partial section of the chain puller of FIG. 1.
Figure 3:
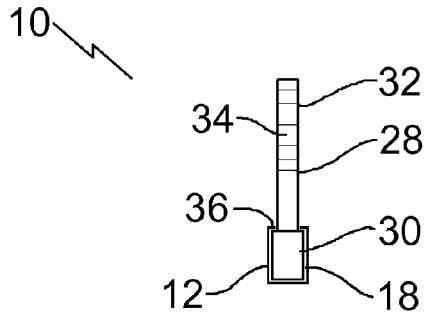
FIG. 3 is an end view in section of the chain puller of FIG. 1.
Figure 4:
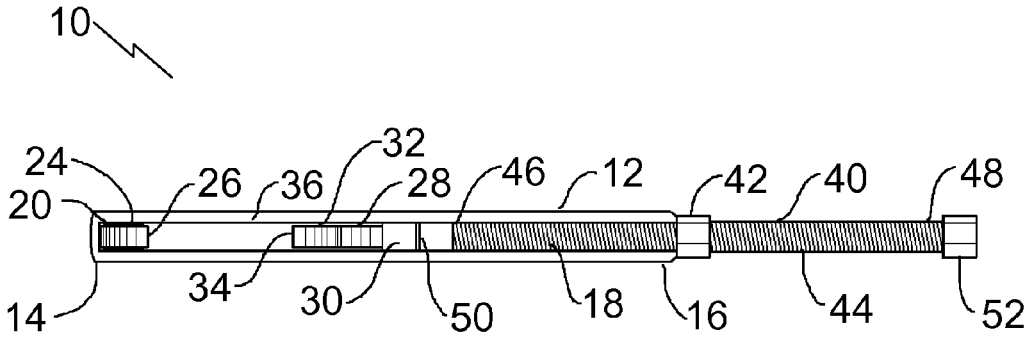
FIG. 4 is a top plan view of the chain puller of FIG. 1.

Structure and Relationship of Parts:

Referring to FIG. 2, chain puller 10 comprises an elongate housing 12 having a first end 14, a second end 16, and a C-shaped channel 18 extending between first end 14 and second end 16. A first chain engaging member 20 is fixedly attached by a lower portion 22 toward first end 14 of housing 12. First chain engaging member 20 also has an upper portion 24, which has a chain engaging face 26 that adapted to be inserted between the links of a chain (not shown). A second chain engaging member 28 has a lower portion 30 that is slideably engaged within C-shaped channel 18 toward second end 16 of housing 12 relative to first chain engaging member 20. As such, second chain engaging member 28 is able to slide within C-shaped channel 18 between first end 14 and second end 16. Second chain engaging member 28 also has an upper portion 32, which has a chain engaging face 34 to be inserted between links of a chain, such that chain engaging face 34 of second chain engaging member 28 faces chain engaging face 26 of first chain engaging member 20. Referring to FIG. 3, lower portion 30 of second chain engaging member 28 is wider that upper portion 32, such that the overhanging lip 36 along the top of C-shaped channel 18 retains lower portion 30 within channel 18. It will be understood that this could also be done in different ways, such as providing a slot through second chain engaging member 28 that separates upper portion 32 from lower portion 30, which could then be of a similar width. However, it has been found that the depicted embodiment is suitable. Referring to FIG. 2, lower portion 22 of first chain engaging member 20 is also wider than upper portion 24 as with second chain engaging member 28, however, referring to FIG. 1, it is welded in place to prevent it from moving. It will be understood that second chain engaging member 28 could be attached to elongate housing 12 in a number of different ways, however, it has been found that the depicted embodiment is suitable.

Figure 5:
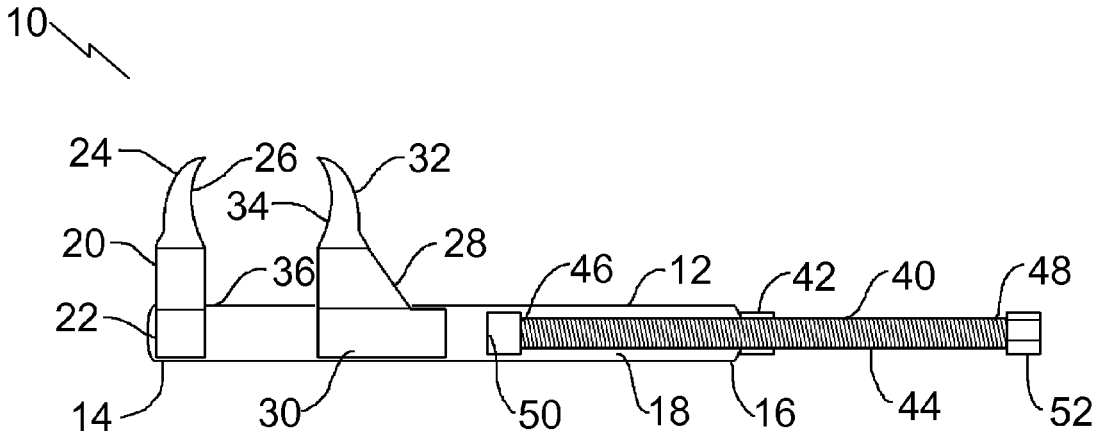
FIG. 5 is a side elevation view in partial section of the chain puller of FIG. 1.

Referring to FIG. 2, the pulling force is provided by a screw actuator 40, which includes a nut 42 fixedly attached toward second end 16 of housing 12 relative to second chain engaging member 28 and a screw member 44 engaged within nut 42. Screw member 44 has a first end 46 and a second end 48. First end 46 has an engagement face 50 extending into C-shaped channel 18 for engaging lower portion 30 of second chain engaging member 28. It will be noted that, while engagement face 50 applies a pushing force to lower portion 30 of second chain engaging member 28, it is not attached, such that second chain engaging member 28 is able to move independently within C-shaped channel 18, as shown in FIG. 5. Second end 48 has means, such as a bolt head 52, for rotating screw member 44, such that rotation in a first direction causes engagement face 50 to advance toward first end 14 of housing 12, and rotation in a second direction causes engagement face to retract toward second end 16 of housing 12. Bolt head 52 allows the user to use a power drill to rotate screw member 44, which allows chain puller 10 to be tightened and loosened easily and quickly. Other means, such as a hand crank, could also be provided.

Operation:

The use and operation of chain puller 10 as describe above with reference to FIG. 1 through 4 will now be described. Referring to FIG. 1, first chain engaging member 20 and second chain engaging member 28 are inserted into the links of a chain (not shown) with chain engaging faces 26 and 34 engaging the links. Torque is then applied to bolt head 52 to cause it to rotate in a first direction, such that screw member 44 causes engagement face 50 to push second chain engaging member 28 toward first chain engaging member, such that the chain links are pulled together to be worked upon.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope defined in the Claims.

What is claimed is:

1. A chain puller comprising:

an elongate housing made from square tubing and having a first end, a second end, and a C-shaped channel extending between the first end and the second end;

a one piece first chain engaging member, the first chain engaging member having an integrally formed lower portion and an integrally formed upper portion, the upper portion having a chain engaging face to be inserted between links of a chain, and the lower portion being fixedly attached toward the first end of the housing;

a one piece second chain engaging member, the second chain engaging member having an integrally formed lower portion and an integrally formed upper portion, the upper portion having a chain engaging face to be inserted between links of a chain, where the chain engaging face of the second chain engaging member faces the chain engaging face of the first chain engaging member, and the lower portion being rectangular in cross-section and slideably engaged within the C-shaped channel toward the second end of the housing relative to the first chain engaging member such that the second chain engaging member slides along within the C-shaped channel between the first end and the second end; and a screw actuator having a nut fixedly attached toward the second end of the housing relative to the second chain engaging member and a screw member engaged within the nut, the screw member having a first end and a second end, the first end having an engagement face extending into the C-shaped channel for engaging the lower portion of the second chain engaging member, and the second end having means for rotating the screw member, such that rotation in a first direction causes the engagement face to advance toward the first end of the housing, and rotation in a second direction causes the engagement face to retract toward the second end of the housing.

* * * * *